US005967371A

United States Patent [19]

Stephen

[11] Patent Number: 5,967,371

[45] Date of Patent: Oct. 19, 1999

[54] BEVERAGE DISPENSING APPARATUS

[75] Inventor: Hogdson T. Stephen, Kilworth, Ireland

[73] Assignee: Charles Wells Limited, United Kingdom

[21] Appl. No.: 09/101,874

[22] PCT Filed: Jan. 17, 1997

[86] PCT No.: PCT/GB97/00122

§ 371 Date: Jul. 20, 1998

§ 102(e) Date: Jul. 20, 1998

[87] PCT Pub. No.: WO97/26209

PCT Pub. Date: Jul. 24, 1997

[30] Foreign Application Priority Data

Jan. 18, 1996 [GB] United Kingdom ..... 9601046
Feb. 23, 1996 [GB] United Kingdom ..... 9603879

[51] Int. Cl.[6] ..... F21V 33/00

[52] U.S. Cl. ..... 222/108; 141/88; 141/94; 222/113; 362/96; 362/101

[58] Field of Search ..... 222/108, 113, 222/129.1, 192; 141/86, 88, 94; 362/96, 101, 154, 205, 318, 802, 806

[56] References Cited

U.S. PATENT DOCUMENTS

| | | | |
|---|---|---|---|
| 1,601,200 | 9/1926 | Davis | 362/96 |
| 2,562,212 | 7/1951 | Rogers et al. | 222/113 |
| 2,745,947 | 5/1956 | Sansous | 362/101 |
| 2,746,646 | 5/1956 | Hall | 222/113 |
| 4,261,026 | 4/1981 | Bolha | 362/101 |
| 4,336,574 | 6/1982 | Goodman | 362/101 |
| 4,344,113 | 8/1982 | Ditto et al. | 362/101 |
| 4,426,021 | 1/1984 | Rosenthal | 222/129.1 |
| 5,010,461 | 4/1991 | Saotome | 362/101 |
| 5,291,378 | 3/1994 | Stone | 222/113 X |
| 5,307,250 | 4/1994 | Pearson | 362/101 |
| 5,491,617 | 2/1996 | Currie | 362/96 |
| 5,492,250 | 2/1996 | Sardynski | 222/108 |
| 5,819,547 | 10/1998 | Oh . | |

FOREIGN PATENT DOCUMENTS

| | | |
|---|---|---|
| 28 55 378 | 6/1980 | Germany . |
| 2 099 791 | 12/1982 | United Kingdom . |
| 2 291 247 | 1/1996 | United Kingdom . |

*Primary Examiner*—Kevin P. Shaver
*Attorney, Agent, or Firm*—Nixon & Vanderhye

[57] ABSTRACT

Beverage dispensing apparatus particularly for dispensing beer into glasses has a light source (21, 34) positioned below a support (20) for the glass (19). The light source is incorporated into spillage collection means (24) which surrounds the support for the glass. The support for the glass is preferably located at the level of a counter (11) on which the apparatus is located so as to be readily visible by customers positioned at the counter. The light source may be switched on and off according to whether a glass is located on the support and the light is transmitted up through the base of the glass to illuminate the contents during dispensing.

9 Claims, 2 Drawing Sheets

BEVERAGE DISPENSING APPARATUS

This invention relates to beverage dispensing apparatus in particular, but not exclusively, dispensing apparatus for dispensing beer or the like.

Beer dispensers conventionally include an outlet, usually in the form of a nozzle, and a tap or other means by which beer is discharged from the nozzle. A beverage container or beer glass is located under the outlet and a support may be provided for the container, the support usually including a drip tray for spillage during dispensing. Conventionally the drip tray is located below the level of the bar counter and the view of the glass into which the beverage is dispensed is obscured from the customer side of the counter.

It has been proposed in FR-A-2465154 to illuminate a beverage container by providing a light source under the container so that the light from said source is directed upwardly into the container. It has also been proposed to incorporate switch means so that the light source operates only when a beverage container is in place.

An object of the invention is to provide beverage dispensing apparatus incorporating a light source.

According to the invention beverage dispensing apparatus comprises a beverage dispensing outlet, a support for a beverage container, spillage collection means associated with the support, a light source incorporated in the support and arranged to direct light towards a beverage container when located on the support, wherein the support has an upwardly directed portion on which the beverage container is arranged to be supported and the light source is arranged to direct light from said portion.

Preferably the spillage collection means surrounds said support and is arranged to collect any spilled beverage below said support.

Conveniently the spillage collection means is an open topped container surrounding said support.

The support may include a transparent upper portion through which said light source directs light upwardly through the base of a beverage container.

The light source may include a switch arranged to be actuated by the location of a beverage container on the support whereby light from the light source is transmitted when a container is located on the support.

The apparatus may be arranged to be located at a bar counter having a serving surface so that the dispensing outlet is located above said surface and said support is located substantially at the level of said surface.

The light source may be a light bulb located in said support. Alternatively the light source may be an optic fibre with the light directed to said support.

The light source may include light emitting means remote from the support with the light directed to the support by light reflecting means.

Further features of the invention will appear from the following description of embodiments of the invention given by way of example only and with reference to the drawings, in which.

Figure 1:
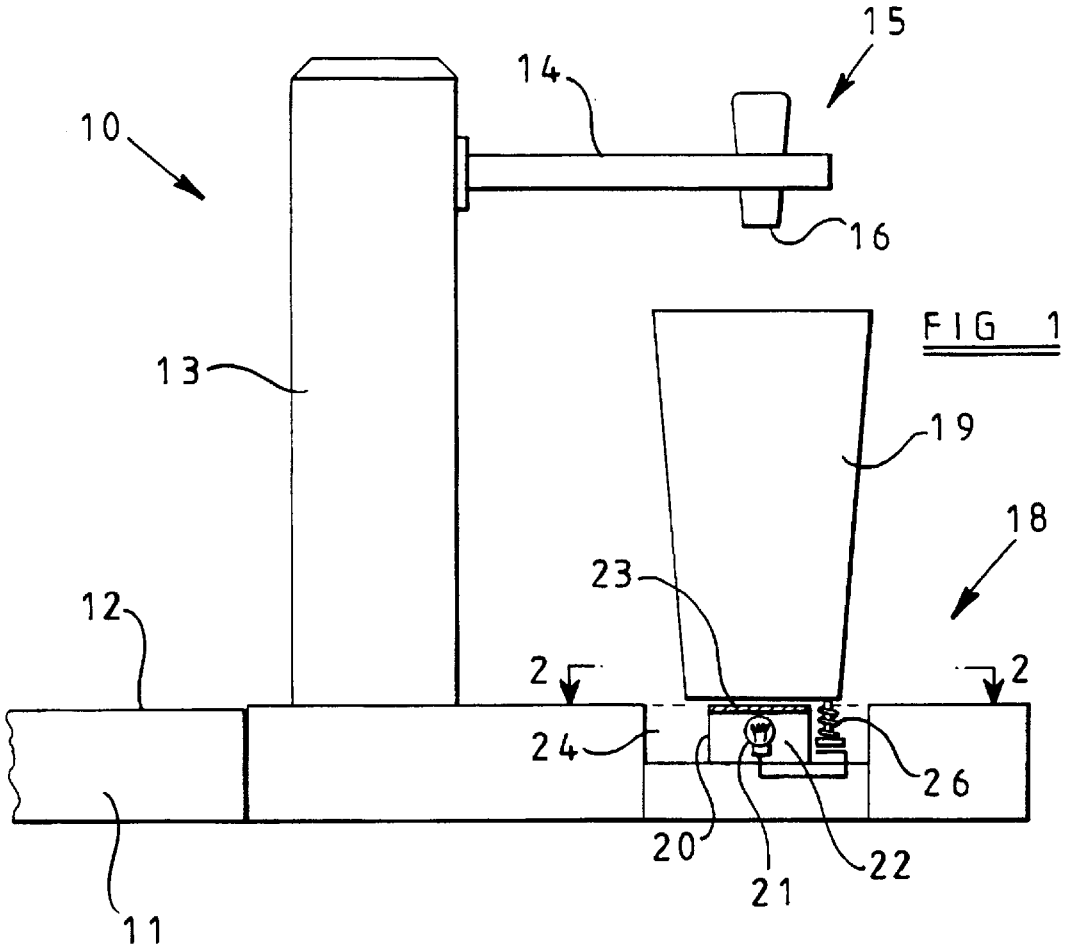
FIG. 1 is a schematic side elevation of beverage dispensing apparatus.
Figure 2:
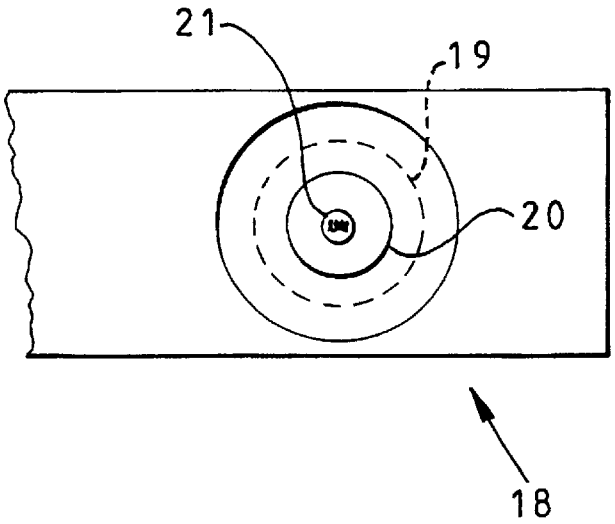
FIG. 2 is a plan view on the line 2—2 in FIG. 1.

Referring to the drawings and firstly to FIGS. 1 and 2, beer dispensing apparatus 10 is shown arranged to be associated with a bar counter 11 having an upper surface 12.

Preferably the apparatus 10 is clamped to the bar counter in known manner. It will be seen that the dispensing apparatus 10 extends upwards above the level of the bar counter surface 12.

The apparatus 10 includes a discharge arrangement for beer or other beverages comprising an upstanding member 13 through which the beverage is ducted and an arm 14 extending outwards and carrying a control valve or tap 15 towards its outer end. The tap 15 includes a nozzle 16 through which the beverage is dispensed.

Under the tap 15 is located a support 18 for a beverage container 19, which is usually in the form of a transparent glass.

The support 18 incorporates a central circular support member 20 on which the base of the glass 19 is mounted and the support member 20 incorporates a light source 21 which is located in a compartment 22 defined by the member 20 and has an upper closure member 23 in the form of a transparent cover. The light source 21 is arranged to direct light upwardly through the cover 23 to the base of the container or glass 19.

The compartment 22 is surrounded by a spillage receiving space 24 which is arranged to receive beverage spilling over from the nozzle 16 and the container 19. Such spillage receiving space 24 is usually termed a drip tray. The receiving space 24 is defined by the support 18 and is usually removable to empty spillage therefrom. At its upper end the spillage space 24 is provided with openings through which the spillage can enter the space 24 so that the space 24 is substantially open at its upper end.

Also incorporated in the support member 20 or adjacent thereto is switch means 26 whereby the presence of the beverage container 19 is detected so that the switch can actuate an electrical supply to the light source 21 and cause the light source to be illuminated. Thus the light source 21 is illuminated when a beverage container 19 is placed on the support member 20.

Various kinds of switch means 26 can be employed including one in which a spring loaded plunger is engaged by the container 19 and moves downwardly to cause the switch contacts to be made, but other switch means can be employed.

It will be seen that the container 19 is located at or about the same level as the surface 12 of the bar counter surface 12 so that the container 19 is visible to the customers at the bar counter whilst the operator, located at the other side of the counter, operates the tap 15 to cause beverage to discharge into the container 19 from the nozzle 16. Beverages display an attractive appearance when being poured into the container 19, particularly when the beverage is beer and the beer is discharged through the nozzle to create a plurality of small bubbles. These bubbles gradually clear from the beer during and after dispensing to present an attractive appearance with light from the light source 21 directed upwardly through the beer.

The space 24 surrounds the support member 20 to receive spillage from around the container 19 and other parts of the support 18 can also be used to receive such spillage.

Instead of the light source being in the form of a bulb, as shown in FIG. 1, the light source may itself be a sealed unit providing the upper surface of the support member 20. Other forms of light source can also be used as described with reference to FIGS. 3 and 4.

Instead of the light source being switched on when the container 19 is in place on the support member 20 the light source may be switched on when the tap 15 is operating and dispensing beer. Alternatively other means for detecting the presence of a container 19 may be employed. For example a light source can be arranged at one side of the container 19 whilst a light sensor is arranged at the other side of the glass so that the presence or otherwise of a container can be detected. As a further alternative the light source 21 may be permanently operative.

The power source for the light source 21 may be from a battery or it may be connected to the power supply lines which normally power the lights for the counter displays. Typically this power supply is a 24 volt power supply.

Figure 3:
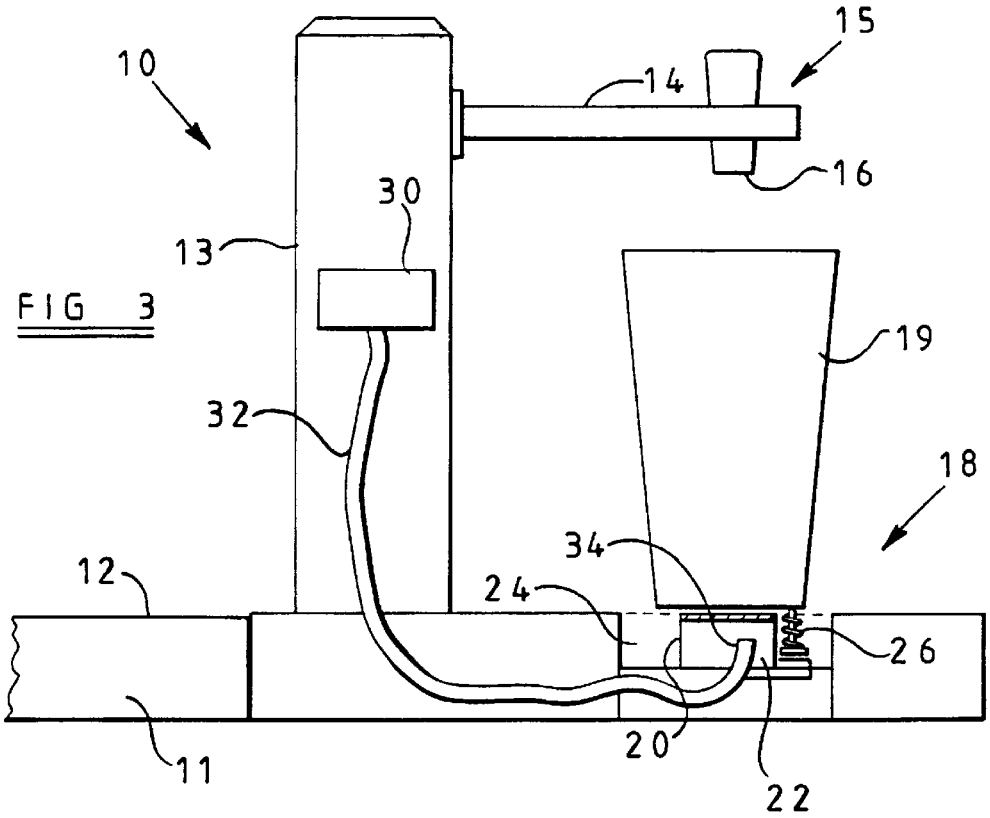
FIG. 3 is a schematic side elevation corresponding to FIG. 1 showing an alternative light source.

Referring now to FIG. 3 a second embodiment of the invention is shown. In this embodiment the light source is not arranged directly below the glass 19 but in other respects the apparatus may be the same or similar to that of FIGS. 1 and 2. In this arrangement a light source 30 is located inside the dispenser part 13 and may be of any suitable kind such as a light bulb. The light source may also be used to illuminate the dispenser through a transparent part of the dispenser on which advertising material may be carried. The light source 30 is connected to an optical fibre 32 which transmits the light to below the container 19 and to direct it upwardly through the container. Thus the end 34 of the fibre 32 is arranged in the support member 22 in place of the light source 21 of FIGS. 1 and 2. Such light source can be switched on and off in a similar manner to that described in relation to FIGS. 1 and 2.

Figure 4:
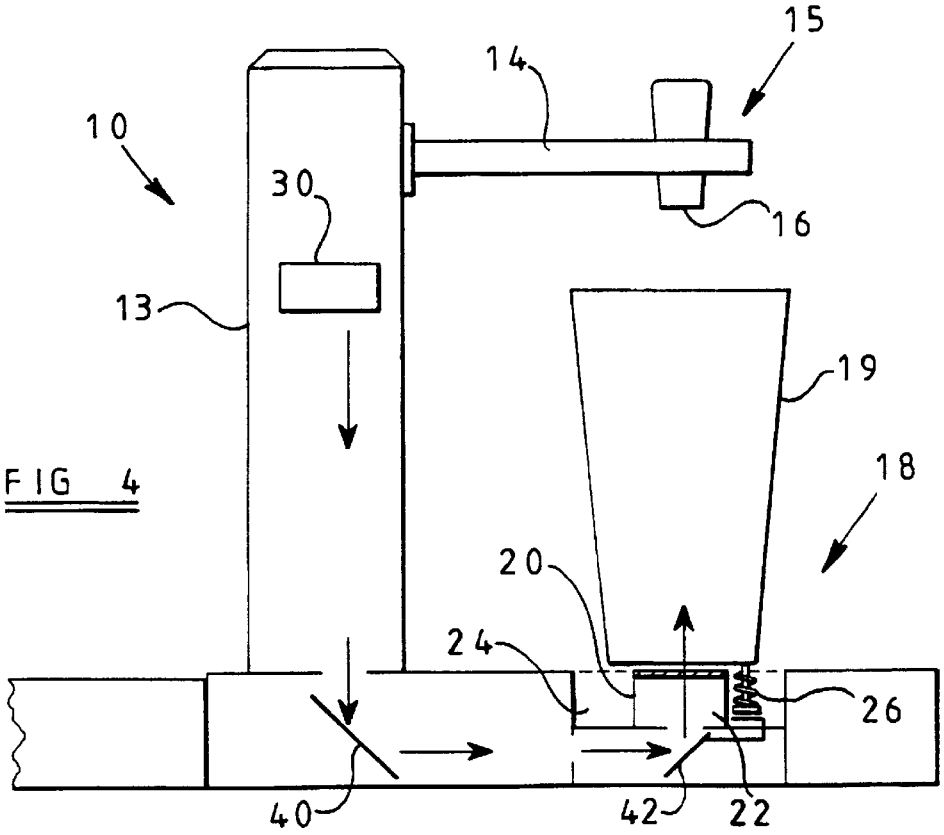
FIG. 4 is a schematic side elevation corresponding to FIG. 1 with a further light source.

FIG. 4 shows a further embodiment of the present invention in which similar parts have the same reference numbers. A light source 30 is provided in the part 13 of the dispenser and instead of an optical fibre 32 transmitting the light to the support member 20 there are provided reflecting means 40 and 42, such as mirrors or prisms for directing light through the support member 20. In this case the base of the support member 20 is transparent or has an opening to transmit light therethrough and through the transparent cover 23.

Preferably the apparatus 10 is presented sideways with respect to the counter 11 so that a customer to one side of the counter 11 can see both the beer dispenser and the container 19. The beer dispenser 13 and the container 19 are thus arranged side by side on the counter 11. This compares with conventional arrangements in which the drip tray and glass are at a lower level than the counter surface 12. In some arrangements the support member 20 for a glass is located above or below the counter surface 12.

In some arrangements the light may be directed through the side of the glass but it has been observed that the best results are achieved if the light is directed upwardly through the base of the container.

Although the invention finds its best application in the dispensing of beer, it can be used in relation to the dispensing of other beverages.

I claim:

1. Beverage dispensing apparatus comprising a beverage dispensing outlet, a support for a beverage container, spillage collection means associated with the support, and a light source incorporated into the support and arranged to direct light towards the beverage container when located on the support, wherein the support has an upwardly directed portion on which the beverage container is arranged to be supported and the light source is arranged to direct light from said portion.

2. Apparatus according to claim 1 wherein the spillage collection means surrounds said support and provides access for spillage into the spillage collection means.

3. Apparatus according to claim 2 wherein the spillage collection means is an open-topped container surrounding said support.

4. Apparatus according to claim 1, wherein the support includes a transparent upper portion through which said light source directs light upwardly into the beverage container through its base.

5. Apparatus according to claim 1 wherein the light source includes a switch arranged to be actuated by the location of a beverage container on the support, whereby light from said light source is transmitted when a container is located on the support.

6. Apparatus according to claim 1 arranged to be located on a bar counter having a surface so that the dispensing outlet is located above said surface and said support and the beverage container are, in use, located substantially at the level of said surface.

7. Apparatus according to claim 1 wherein the light source is a light bulb located in said support.

8. Apparatus according to claim 1 wherein the light source includes an optical fibre.

9. Apparatus according to claim 1 wherein the light source includes a light emitting means remote from the support and light is directed to the support by light reflecting means.

* * * * *